US012498191B1

(12) United States Patent
Hynds

(10) Patent No.: US 12,498,191 B1
(45) Date of Patent: Dec. 16, 2025

(54) ADJUSTABLE TRIGGER ASSEMBLY AND METHOD OF ADJUSTING PRE-TRAVEL DISTANCE

(71) Applicant: Sean Hynds, Nacogdoches, TX (US)

(72) Inventor: Sean Hynds, Nacogdoches, TX (US)

( * ) Notice: Subject to any disclaimer, the term of this patent is extended or adjusted under 35 U.S.C. 154(b) by 0 days.

(21) Appl. No.: 18/752,415

(22) Filed: Jun. 24, 2024

Related U.S. Application Data

(63) Continuation of application No. 18/204,678, filed on Jun. 1, 2023, now Pat. No. 12,018,903, which is a continuation of application No. 17/388,254, filed on Jul. 29, 2021, now Pat. No. 11,719,499, which is a continuation of application No. 29/719,752, filed on Jan. 7, 2020, now Pat. No. Des. 1,010,053, and a continuation of application No. 16/697,692, filed on Nov. 27, 2019, now Pat. No. 11,105,575.

(51) Int. Cl.
*F41A 19/16* (2006.01)

(52) U.S. Cl.
CPC ..... *F41A 19/16* (2013.01)

(58) Field of Classification Search
CPC ..... F41A 19/16; F41A 19/17; F41A 19/10
See application file for complete search history.

(56) References Cited

U.S. PATENT DOCUMENTS

| | | | |
|---|---|---|---|
| 984,519 | A | 2/1911 | Browning |
| 4,691,461 | A | 9/1987 | Behlert |
| 4,955,155 | A | 9/1990 | Jones |
| 5,365,911 | A | 11/1994 | Todd |
| 5,822,903 | A | 10/1998 | Davis, Sr. |
| 6,070,512 | A | 6/2000 | Rohrbaugh |
| 6,164,001 | A | 12/2000 | Lee |
| 6,298,594 | B1 | 10/2001 | Strayer |
| 6,802,305 | B1 | 10/2004 | Hatcher |
| 7,010,878 | B1 | 3/2006 | du Plessis |
| 7,231,911 | B2 | 6/2007 | Hatcher |
| 7,743,543 | B2 | 6/2010 | Karagias |
| 9,046,313 | B1 | 6/2015 | Lutton et al. |
| 9,052,149 | B2 | 6/2015 | Bender |
| 9,170,063 | B2 | 10/2015 | Krieger |

(Continued)

FOREIGN PATENT DOCUMENTS

DE 20 2016 006 641 U1 12/2016

OTHER PUBLICATIONS

The Allen Safety Set Screw, The Allen Manufacturing Co., Inc., https://en.wikipedia.org/wiki/Allen_(brand)#/media/File:Allen_Mfg_Co_Inc_1913_advert_in_Auto_Trade_Dir.png (published prior to Nov. 27, 2019)(1 page).

(Continued)

*Primary Examiner* — J. Woodrow Eldred
(74) *Attorney, Agent, or Firm* — Jackson Walker LLP; Edward B. Marvin

(57) ABSTRACT

A trigger assembly apparatus for a firearm which allows adjustment of the pre-travel distance a trigger travels before initiating a firing sequence and method of making the pre-travel adjustment using the apparatus disclosed herein. The apparatus generally comprises a trigger and a trigger bow, with the trigger bow having at least one threaded receptacle in a front lateral portion thereof. The pre-travel adjustment can be achieved by rotating a threaded fastener within the threaded receptacle and the method of adjusting the pre-travel can be accomplished without complete disassembly of the firearm.

33 Claims, 8 Drawing Sheets

(56) References Cited

U.S. PATENT DOCUMENTS

| | | | | |
|---|---|---|---|---|
| 9,255,750 | B1 | 2/2016 | Huber | |
| 9,541,342 | B1 | 1/2017 | Blake | |
| 9,625,227 | B2 | 4/2017 | Lee | |
| 9,638,485 | B2 | 5/2017 | Geissele | |
| 9,915,491 | B2 | 3/2018 | Perry | |
| 9,927,198 | B2 | 3/2018 | Geissele | |
| 9,952,013 | B2 | 4/2018 | Fellows et al. | |
| 9,970,724 | B1 | 5/2018 | Acker | |
| 9,989,327 | B2 | 6/2018 | Horch | |
| 10,006,727 | B2 | 6/2018 | Barrett et al. | |
| 10,077,960 | B2 | 9/2018 | Geissele | |
| 10,113,821 | B1 | 10/2018 | Pavlick | |
| 10,274,277 | B2 | 4/2019 | Indruch | |
| 10,288,372 | B2 | 5/2019 | Pavlick | |
| 10,295,289 | B2 | 5/2019 | Geissele | |
| 10,330,415 | B2 | 6/2019 | Niswander et al. | |
| 10,378,847 | B2 | 8/2019 | Folk et al. | |
| 10,458,736 | B2 | 10/2019 | Galie et al. | |
| 10,605,549 | B2 | 3/2020 | Barrett et al. | |
| 11,105,575 | B1 * | 8/2021 | Hynds | F41A 19/16 |
| 11,320,234 | B1 | 5/2022 | Simon | |
| 11,719,499 | B1 * | 8/2023 | Hynds | F41A 19/16 42/69.01 |
| 12,018,903 | B1 * | 6/2024 | Hynds | F41A 19/16 |
| 2012/0117841 | A1 | 5/2012 | Joubert et al. | |
| 2013/0104435 | A1 | 5/2013 | Fuller | |
| 2013/0180394 | A1 | 7/2013 | Siddle | |
| 2016/0084600 | A1 | 3/2016 | Siddle | |
| 2018/0266778 | A1 | 9/2018 | Noonan et al. | |
| 2018/0299221 | A1 | 10/2018 | Indruch | |
| 2019/0041150 | A1 | 2/2019 | Lopata et al. | |
| 2019/0137206 | A1 | 5/2019 | Lopata | |
| 2022/0163278 | A1 | 5/2022 | Miller | |
| 2022/0268551 | A1 | 8/2022 | Noonan et al. | |

OTHER PUBLICATIONS

Metric Socket Set Screws, The Hillman Group, https://www.hillmangroup.com/us/en/Fastening-Solutions/Fasteners/Screws/Socket-Set-Screws/Metric-Socket-Set-Screws/p/918136 (published prior to Nov. 27, 2019)(2 pages).

Jerry Kuhnhausen, The U.S. M1911 / M1911A1 Pistols & Commercial M1911 type Pistols: A Shop Manual (vol. II) (1997) (208 pages).

Geppert Shooting X-tras webpage for triggers, http://www.xline-geppert.de/en/12-trigger, webpage no longer exists, printouts from Internet Archive (i.e., the "Wayback Machine") (published prior to Nov. 27, 2019 )(6 pages).

Geppert Shooting X-tras webpage for Geppert Hinge Trigger, http://www.xline-geppert.de/en/28-x-line-trigger.html, webpage no longer exists, printouts from Internet Archive (i.e., the "Wayback Machine") (published prior to Nov. 27, 2019)(4 pages).

Infinity Firearms "Trigger Bow—Wide Body" webpage, https://infinity.americommerce.com/p/146-Trigger-Bow-Wide-Body.aspx (published prior to Nov. 27, 2019) (4 pages).

"STI-1911 Match Grade Triggers" webpage from Brownells Website, https://www.brownells.com/handgun-parts/trigger-group-parts/trigger-parts/triggers/1911-match-grade-triggers-prod22722.aspx (published prior to Nov. 27, 2019) (1 page).

Wilson Combat Triggers webpage, https://shopwilsoncombat.com/Triggers/products/97/ (published prior to Nov. 27, 2019) (3 pages).

Wilson Combat Competition Match Trigger Long Pad webpage, https://shopwilsoncombat.com/Trigger-Competition-Match-Long-Pad/productinfo/1/ (published prior to Nov. 27, 2019) (3 pages).

Wilson Combat Ultralight Match Trigger Short Pad webpage, https://shopwilsoncombat.com/Trigger-Ultralight-Match-Short-Pad/productinfo/190S/ {published prior to Nov. 27, 2019) (4 pages).

Wilson Combat Ultralight Match Trigger Long (Standard) Pad webpage, https://shopwilsoncombat.com/Trigger-Ultralight-Match-Long-Standard-Pad/productinfo/190/ (published prior to Nov. 27, 2019) (6 pages).

Wilson Combat Ultralight Match Trigger Flat Pad webpage, https://shopwilsoncombat.com/Trigger-Ultralight-Match-Flat-Pad/productinfo/190F/ (published prior to Nov. 27, 2019) (4 pages).

Wilson Combat Ultralight Match Trigger Solid Pad webpage, https://shopwilsoncombat.com/Trigger-Ultralight-Match-Solid-Pad-No-Holes/productinfo/190NH/ (published prior to Nov. 27, 2019) (3 pages).

Wilson Combat Ultralight Match Trigger Long (Standard) Pad Gold Cup webpage, https://shopwilsoncombat.com/Trigger-Ultralight-Match-Long-Standard-Pad-Gold-Cup/productinfo/190G/ (published prior to Nov. 27, 2019) (4 pages).

Wilson Combat Ultralight Match Trigger Solid Pad Gold Cup webpage, https://shopwilsoncombat.com/Trigger-Ultralight-Match-Long-Solid-Pad-No-Holes-Gold-Cup/productinfo/190G-NH/ (published prior to Nov. 27, 2019) (4 pages).

Ed Brown Products Trigger webpage, https://www.edbrown.com/product/trigger/, (published prior to Nov. 27, 2019) (4 pages).

Shooters Connection web page, https://www.shootersconnectionstore.com/Geppert-X-Line-2011-Trigger-p4949. aspx (published prior to Nov. 27, 2019) (4 pages).

Colt Forum web page for thread titled "Correct Trigger on a 1918 M1911", https://www.coltforum.com/threads/correct-trigger-on-a-1918-m1911.414180/ (discussing triggers stated to be in use prior to Nov. 27, 2019) (17 pages).

* cited by examiner

ADJUSTABLE TRIGGER ASSEMBLY AND METHOD OF ADJUSTING PRE-TRAVEL DISTANCE

CROSS-REFERENCES TO RELATED APPLICATIONS

This application is a continuation of U.S. application Ser. No. 18/204,678, filed Jun. 1, 2023, which was a continuation of U.S. application Ser. No. 17/388,254, filed Jul. 29, 2021, which was a continuation of U.S. application Ser. No. 16/697,692, filed on Nov. 27, 2019, and of U.S. application Ser. No. 29/719,752, filed Jan. 7, 2020. All of the foregoing related applications, in their entirety, are incorporated herein by reference.

BACKGROUND

1. Field of the Invention

The present invention relates to adjusting the pre-travel distance for a trigger on a firearm. More specifically, the invention comprises a trigger assembly that allows for finer pre-travel adjustment and a method for adjusting the pre-travel.

2. Description of the Related Art

Pre-travel refers to the longitudinal distance the trigger assembly must travel before the firing sequence begins and excessive pre-travel is undesirable for a few reasons. First, it increases the amount of time a person shooting the firearm must hold the firearm aimed at the target, which thereby increases the risk that the firearm will be moved off target and a resulting errant shot. Second, each incident of excessive pre-travel can aggregate into a significant amount of time if firing multiple shots in rapid succession. The aggregated time can prove to be costly if, for example, the shooter is engaged in competitive shooting or, worse yet, if the person is firing in rapid succession in a self-defense situation.

Recognizing the problem of excessive pre-travel, manufacturers have developed an adjustable trigger assembly for firearms that utilizes a trigger assembly comprising a trigger bow and trigger. These pre-existing adjustable trigger assemblies use bendable adjustment tabs to reduce the amount of pre-travel, but these types of adjustable assemblies and the method of adjusting pre-travel they employ are less than desirable for reasons discussed infra.

BRIEF SUMMARY

The present invention provides a more desirable adjustable trigger assembly that allows for finer pre-travel adjustments, and a more desirable method of making such adjustments. In this regard, the present invention comprises a trigger assembly having a trigger bow with one or more internally threaded receptacles disposed therein, along with an externally threaded fastener (e.g., a socket screw) to thread within each of the one or more internally threaded receptacles.

The adjustable trigger assembly of the present invention allows the pre-travel to be more easily and accurately adjusted. Instead of the pre-existing method, which requires complete disassembly and re-assembly of the firearm, the present method provides for adjustment without complete disassembly. It also offers finer adjustments to be made to the pre-travel and more secure adjustments.

Under the present method, a user makes the pre-travel adjustment by removing the firearm slide and inserting a driving tool into the firearm frame from above the magazine well. The externally threaded fastener is accessible to the driving tool and the user can rotate the threaded fastener in accordance with the desired pre-travel adjustment. More specifically, a user can drive the threaded fastener into the internally threaded receptacle and decrease the amount of pre-travel by rotating the fastener in one direction, or can reverse the direction of rotation and back the threaded fastener out of the receptacle to increase the amount of pre-travel.

DETAILED DESCRIPTION

Figure 1:
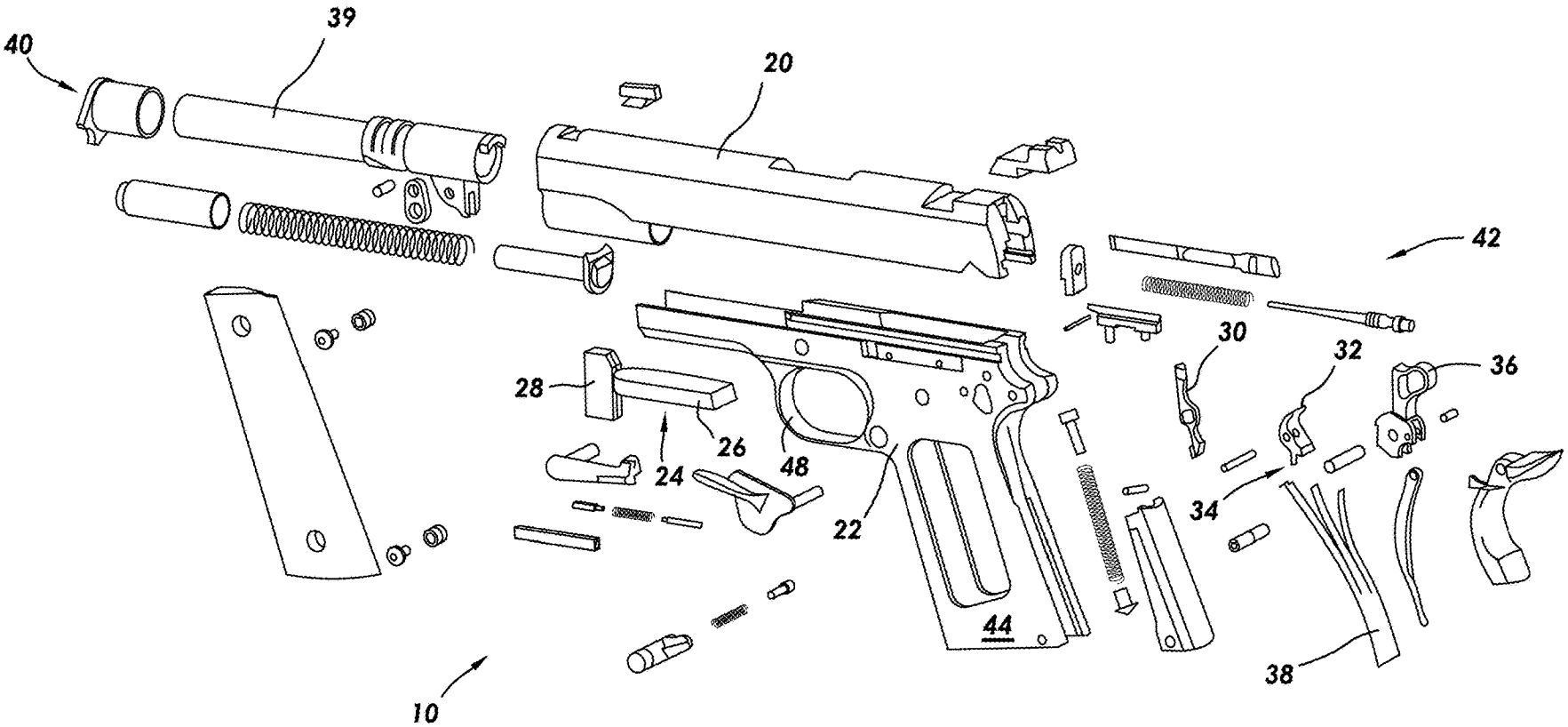
FIG. 1 (PRIOR ART)
FIG. 1 shows an exploded view of a 1911 style firearm, illustrating its internal component parts.
Figure 3:
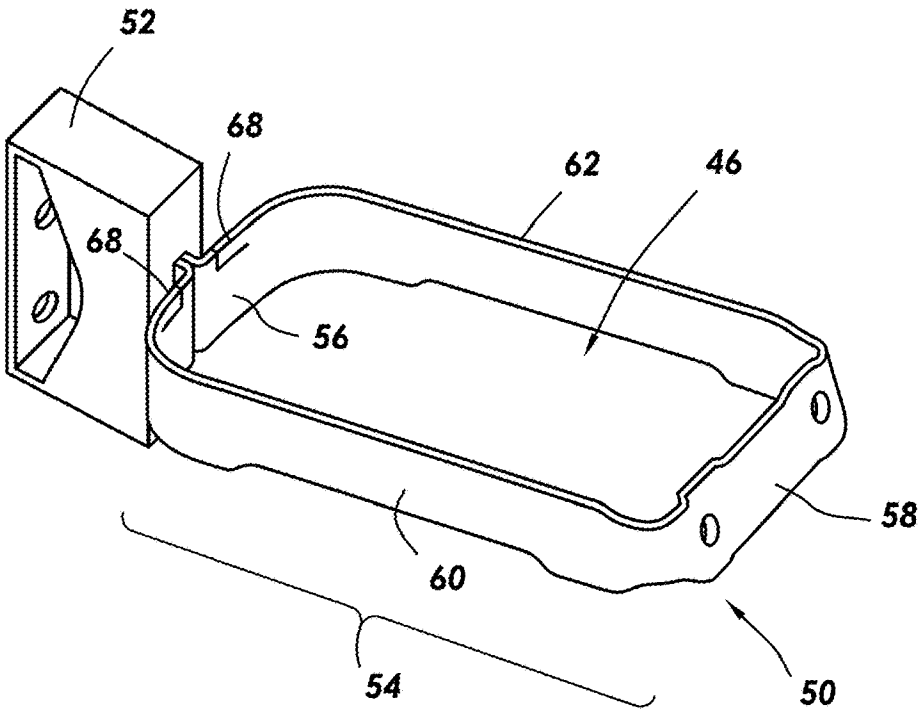
FIG.3 (PRIOR ART)
FIG. 3 shows a top perspective view of the pre-existing trigger assembly of FIG. 2.

FIG. 1 shows an exploded view of a 1911 style firearm 10, and a discussion of its assembly will help explain pre-travel. The firearm 10 comprises a slide 20, a frame 22, a trigger assembly 24 having a trigger bow 26 and a trigger 28, a disconnector 30, a sear 32 and its associated sear feet 34, a hammer 36, a sear spring 38, and a barrel 39. The firearm 10 also has a muzzle end 40 and a rear end 42 with a handle or grip 44. A much more comprehensive and detailed version of these parts can be seen, for example, in U.S. Pat. No. 984,519 to Browning and in a publication titled "The U.S. M1911/M1911A1 Pistols & Commercial M1911 type Pistols: A Shop Manual: Volume II in the Kuhnhausen .45 Auto Series" by Jerry Kuhnhausen in 1997 ("Kuhnhausen Publication"), both of which are incorporated herein by reference in their entirety.

Figure 2:
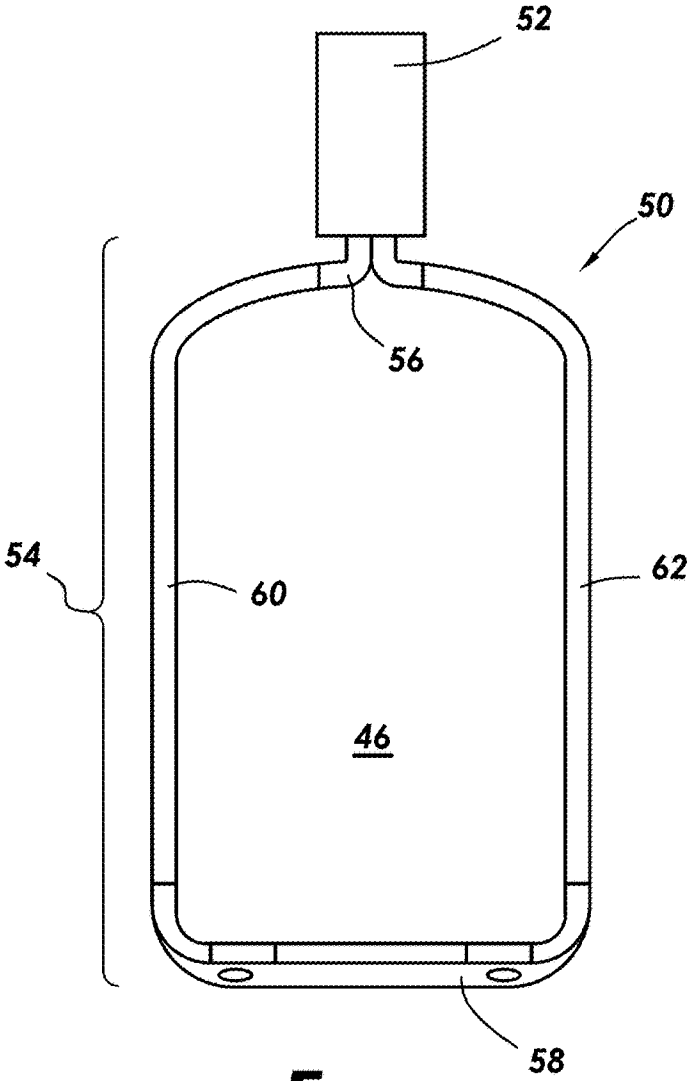
FIG.2 (PRIOR ART)
FIG. 2 shows a top view of a pre-existing trigger assembly.

Assembly of the parts shown in FIG. 1 is well known in the art. When assembled, the trigger bow 26 is inside the frame 22 and extends around the inner perimeter of the grip 44. The trigger bow 26 defines an opening 46 (see, e.g., FIG. 2) and when a clip or magazine (not shown) is inserted into the grip 44, the magazine extends through the opening 46. The magazine does not occupy the entire opening 46 and there is space between the bow 26 and the magazine, which allows the trigger bow 26 to be displaced rearward and forward when the trigger 28 is pulled and released during the firing sequence. Meanwhile, the rear end of the trigger bow 26 rests against the disconnector 30 and the trigger 28 extends from the front end of the bow 26 toward the muzzle end 40 of the firearm 10, with the trigger 28 positioned within a trigger guard 48.

Once assembled, the trigger bow 26 travels longitudinally on the frame 22 within the grip 44 to initiate the firing sequence. More specifically, a user pulls the trigger 28 toward the rear end 42 of the firearm 10 to begin the firing sequence, which causes the trigger bow 26 and the disconnector 30 to move rearward until the disconnector 30 contacts the sear feet 34 on the sear 32. As the trigger 28 continues to be pulled rearward, the disconnector 30 pushes against the sear feet 34, which causes the sear 32 to rotate. Rotation of the sear 32 starts the internal sequence to move and/or release the hammer 36, and the distance the trigger bow 26 and disconnector 30 must travel before making contact with the sear feet 34 is known as the pre-travel.

Often, there is a desire to reduce the amount of pre-travel during a trigger pull. Presently, the amount of pre-travel on 1911 and 2011 style pistols can be adjusted, but the process is a very time consuming, cumbersome, and inaccurate, requiring complete disassembly of the firearm 10 and rudimentary bending of small metal adjustment tabs located on the front of the trigger bow.

Figure 5:
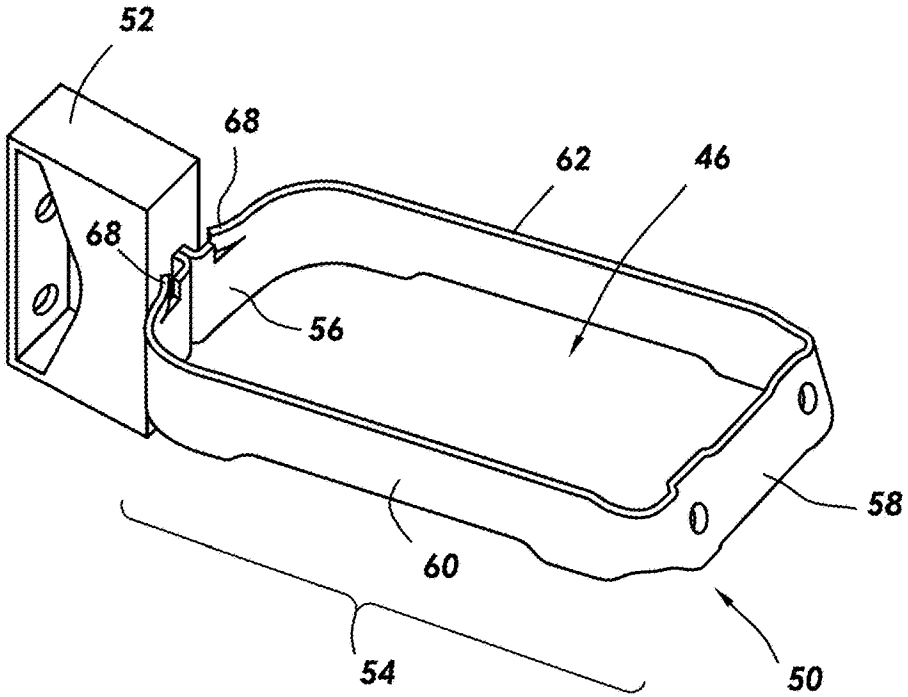
FIG.5 (PRIOR ART)
FIG. 5 shows the same top perspective view as FIG. 3, but with adjustment tabs shown bent outward.
Figure 4:
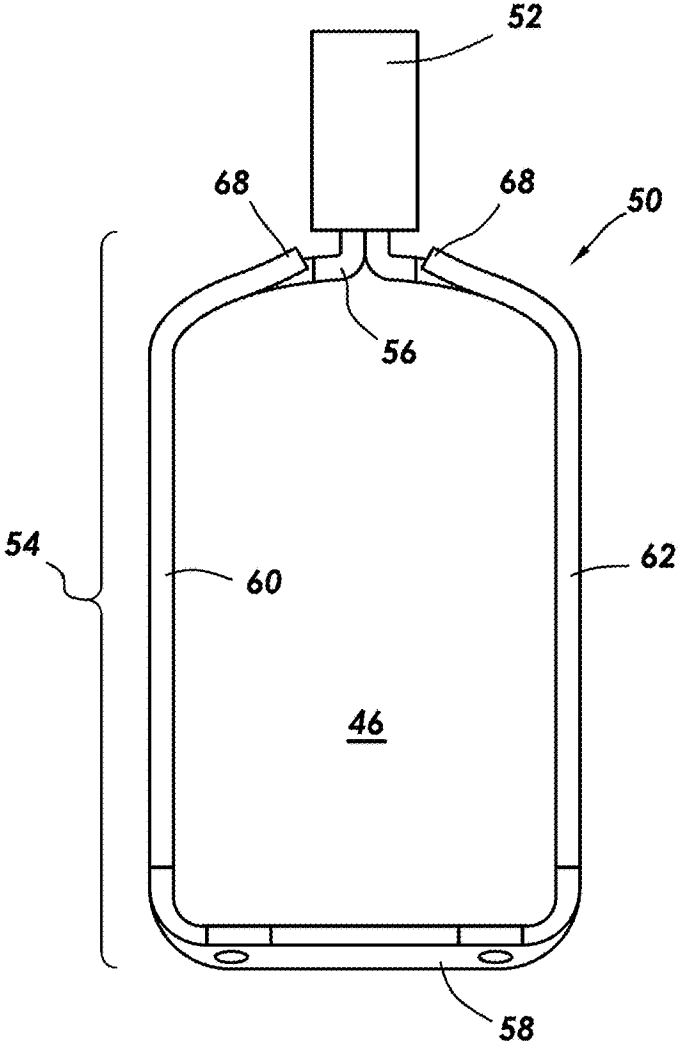
FIG.4 (PRIOR ART)
FIG. 4 shows the same top view as FIG. 2, but with adjustment tabs shown bent outward.

FIGS. 2-5 show one type of a pre-existing trigger assembly 50 that may be used in the typical pre-travel adjustment process, prior to the present disclosure. The pre-existing trigger assembly 50 has a trigger 52 and a bow 54. The bow 54 has a front lateral cross member 56 at its front end, a rear lateral cross member 58 at its rear end, and two side cross members 60, 62. The side cross members 60, 62 extend longitudinally between the front lateral cross member 56 and the rear lateral cross member 58, and all the cross members are connected at rounded corners, thereby forming the opening 46 through which a clip or magazine can extend. At least one, and often two, adjustment tabs 68 are within the front lateral cross member 56 and the user bends the tabs 68 in a direction toward the trigger 52, as shown in FIGS. 4-5, to make the pre-travel adjustment. The user typically bends the tabs 68 using a pair of needle nose pliers (or a similar tool), while estimating the desired position of the tabs 68 to make the proper adjustment.

Figure 7:
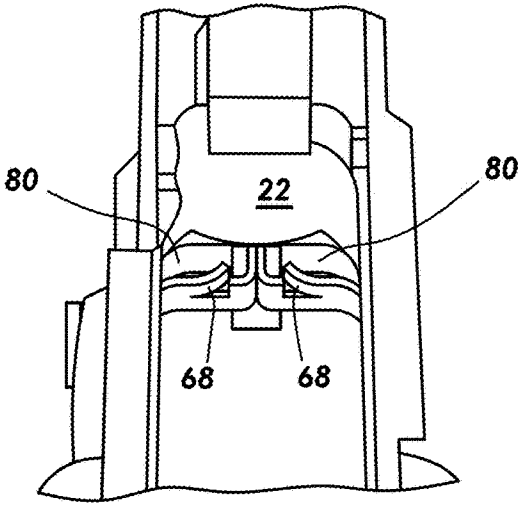
FIG.7 (PRIOR ART)
FIG. 7 is a close-up, cutaway view of FIG. 6.
Figure 6:
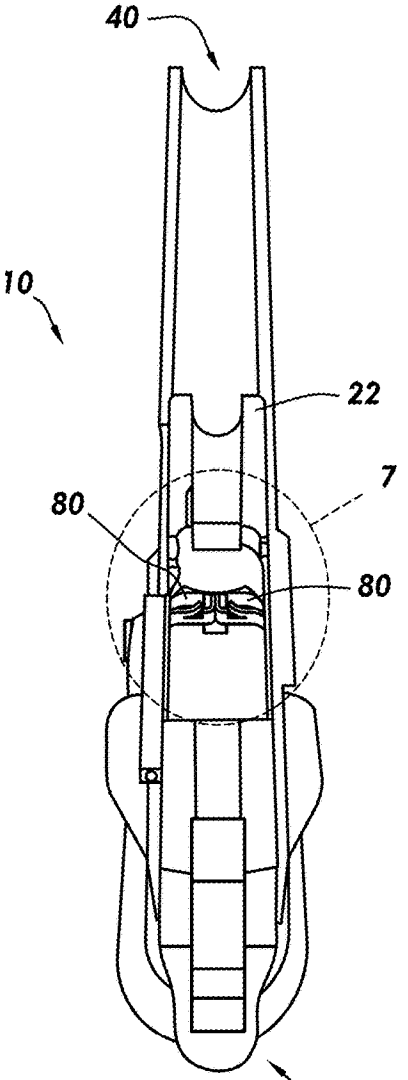
FIG.6 (PRIOR ART)
FIG. 6 is a top perspective view of a firearm with the slide removed and illustrates the pre-existing trigger assembly of FIGS. 2-5 installed on the firearm.

The purpose of bending the tabs 68 toward the trigger 52 is to move the trigger assembly 50 rearward in the frame of the pistol, thereby shortening or eliminating the distance the trigger bow 54 and the disconnector (not shown) must travel before they make contact with the sear feet (not shown). More specifically, as shown in FIGS. 6-7, the bended tabs 68 rest against an interior wall 80 of the frame 22 and position the trigger assembly 50 further into the grip toward the rear end 42 of the firearm 10 than if the tabs 68 were not bent.

Bending the tabs 68 is a cumbersome process. It requires removal of the trigger assembly 50 from the frame 22, necessitating complete firearm disassembly. The pre-existing process becomes even more cumbersome because estimating how far the tabs 68 must be bent to obtain the desired pre-travel reduction is inexact, and the firearm must be reassembled with the adjusted trigger assembly 50 installed to determine if the tabs 68 were bent to the correct degree.

On average, individuals who are familiar with the firearm assembly process take approximately 15-20 minutes to reassemble a 1911 or 2011 style pistol, while those unfamiliar with the assembly process can expect to take at least 30-45 minutes. Only after the firearm is properly reassembled can the user determine if too much or too little pre-travel was removed. If the tabs 68 were bent too far forward (i.e., toward the muzzle end 40) and too much pre-travel was removed, the trigger bow 54 will sit too deep in the frame. As such, the disconnector cannot return forward enough to its proper resting position, which, in turn, holds the sear in a position that prevents the hammer from staying cocked. In contrast, if the tabs 68 were not bent forward enough, there will still be unwanted pre-travel. If too little or too much adjustment of the tabs 68 were made, the user must completely disassemble and reassemble the pistol, repeating the process until the desired pre-travel adjustment is finally obtained.

Bendable adjustment tabs 68 are also not desirable because the tabs 68 eventually get bent back to their original position due to internal operation. Referring generally to FIGS. 1-5, when the firearm 10 is assembled, the sear spring 38 applies pressure against the disconnector 30 and the disconnector 30 pushes against the rear lateral cross member 58 of the trigger bow 26 (i.e., referred to as bow 54 in FIGS. 2-5). This spring pressure ultimately forces the trigger 28 (i.e., referred to as trigger 52 in FIGS. 2-5) forward in the frame 22, thus resetting the trigger 28 for the next shot; however, the adjustment tabs 68 stop the forward movement of the trigger assembly 24 (i.e., referred to as assembly 50 in FIGS. 2-5) and the tabs 68 experience force back toward their original, pre-bent position. More specifically, the sear spring 38 forces the trigger assembly 24 forward in the pistol frame 22 until the tabs 68 contact the interior wall 80 of the frame 22 (see, e.g., FIG. 7) and, although the trigger assembly 24 may be held static, the sear spring 38 continually forces the assembly 24 forward, thereby causing the interior wall 80 to exert a rearward normal force equal to and in the opposite direction of the resulting sear spring force against the tabs 68. The constant spring pressure from the sear spring 38 causes the adjustment tabs 68 to push continually against the interior wall 80 of the frame 22, which puts internal stress on the tabs 68 to bend back toward their original, pre-bent position. Further, frequent firearm use increases the internal stresses on the tabs 68 and increases their tendency to be bent toward their original, pre-bent position because the tabs 68 repetitively hit against the interior wall 80 of the frame 22 when the trigger 28 resets after each shot.

If the tabs 68 bend back toward their original, pre-bent position, the pre-travel will increase, thereby requiring another sequence of firearm disassembly and reassembly to reposition the adjustment tabs back to the desired setting. Further, after several instances of re-bending the tabs 68, the metal tabs will fatigue and be even less likely to hold the trigger assembly 24 in the desired position for pre-travel reduction, leading to more time-consuming adjustments. Worse yet, the tabs 68 will ultimately break if the metal fatigue becomes too great, thus requiring acquisition of another trigger bow 26.

Figure 8:
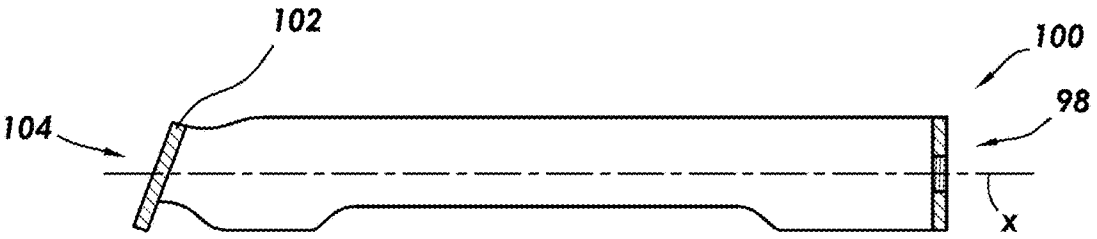
FIG. 8 is a side cross-section view of an embodiment of the present invention taken along section line 8-8 in FIG. 9 and with an axis x extending through a threaded receptacle.
Figure 9:
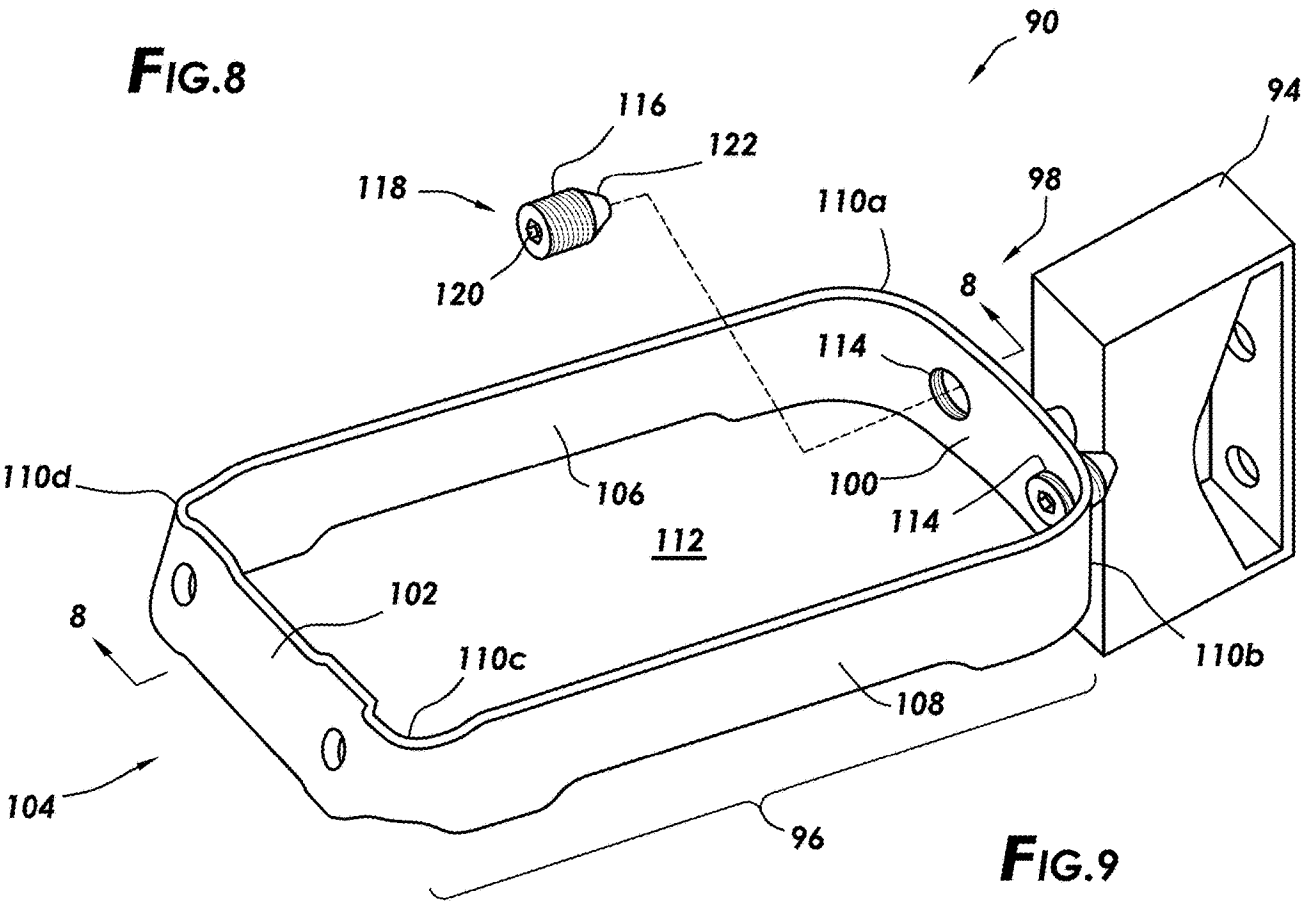
FIG. 9 is a top perspective view of the embodiment, with a projected line showing assembly of a threaded fastener into a threaded receptacle.

FIGS. 8-10 show an embodiment 90 of the present invention. The embodiment 90 comprises a trigger 94 and a bow 96. Bow 96 has a front end 98 with a front lateral cross member 100, a rear end 104 opposite the front end 98, a rear lateral cross member 102 at the rear end 104, and two side cross members 106, 108. The side cross members 106, 108 extend between the front lateral cross member 100 and the rear lateral cross member 102, and all the cross members are connected at rounded corners 110*a*, 110*b*, 110*c*, 110*d* to define an opening 112 in the bow 96 through which a clip or magazine (not shown) can extend.

Preferably, the bow 96 is formed from a single, integral piece of material, milled from metal stock using a CNC machine, as best shown in FIG. 9; however, alternative embodiments may be constructed differently. Additionally, the front lateral cross member 100 is preferably a single, integral piece of material, but alternative embodiments may be formed from two or more pieces of material. For example, in an alternative embodiment, the front lateral cross member 100 may be formed by two pieces of material converging together such as that shown in FIGS. 2-5, or FIGS. 12A-12B.

The opening 112 in the embodiment 90 is designed to receive a double-stack magazine (not shown), but opening 112 may be smaller to receive a single-stack magazine (not shown) in an alternative embodiment. In the double stack embodiment 90, the bow 96 ideally has an outside width (OW) ranging 1.18-1.21 inches, an inside width (IW) ranging 0.955-0.96 inches, a maximum outside length (OL) ranging 1.7-1.75 inches, and a height (H) ranging 0.24-0.26 inches.

As shown in FIG. 9, the front lateral cross member 100 defines at least one, and preferably two, internally threaded receptacles 114. The threaded receptacles 114 extend through the front lateral cross member 100 in a generally longitudinal direction, and preferably along an axis x, as shown in FIG. 8. Axis x is preferably aligned generally parallel to the barrel axis of the firearm 10 (i.e., the axis circumscribed by the barrel 39) when the firearm 10 is assembled and the embodiment 90 is installed. Additionally, the front lateral cross member 100 may be thickened to achieve a greater thread count. More specifically, the preferred thickness for the front lateral cross member ranges 0.035-0.200 inches, while the thickness of the other cross members is ideally on the lower end of that range or less. For example, the thickness of the rear lateral cross member 102 and the side cross members 106, 108 in the double stack embodiment 90 may range 0.035-0.038 inches, while the thickness for those cross members in a single stack embodiment may range 0.024-0.031 inches.

In the preferred embodiment, one of the threaded receptacles 114 is on one side of the front lateral cross member 100 and the other of the threaded receptacles 114 is on the other side of the front lateral cross member 100. In this regard, one of the two threaded receptacles 114 is preferably between the rounded corner 110*a* and the connection of the trigger 94 to the bow 96 and the other of the two threaded receptacles 114 is preferably between the rounded corner 110*b* and the connection of the trigger 94 to the bow 96.

As shown in FIG. 9, the receptacles 114 are threaded to engage with external (i.e., male) threads 116 on a threaded fastener 118. Preferably, threaded fastener 118 is a set screw without a head and has a hexagonal socket 120 to receive an Allen wrench (a/k/a an Allen key or hex key), but other types of threaded fasteners (not shown) may be utilized. Additionally, threaded fastener 118 preferably has a conical tip 122, but tip 122 may be shaped differently in alternative embodiments.

Figure 10C:
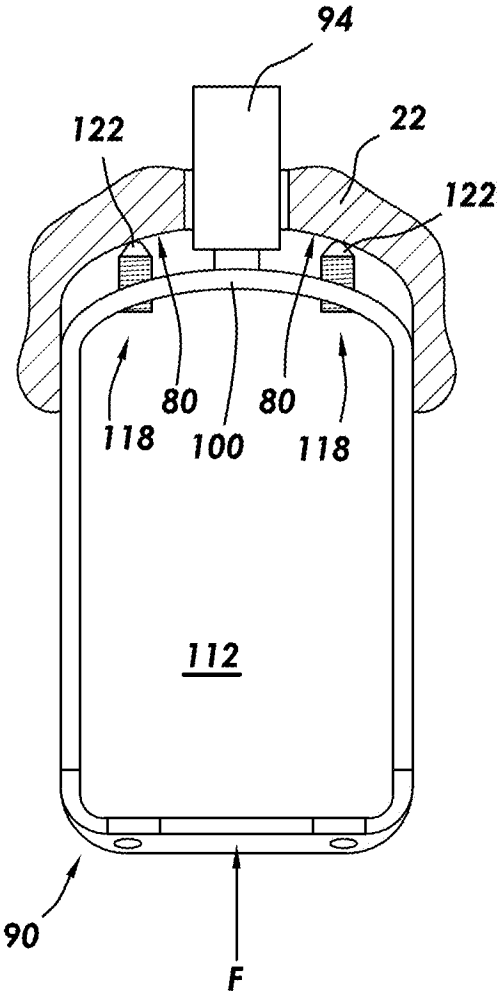
FIGS. 10A-10C are cutaway cross-sectional views of the embodiment installed on a firearm, with the embodiment in varying degrees of pre-travel adjustment and with arrows illustrating a forward direction F.
Figure 10B:
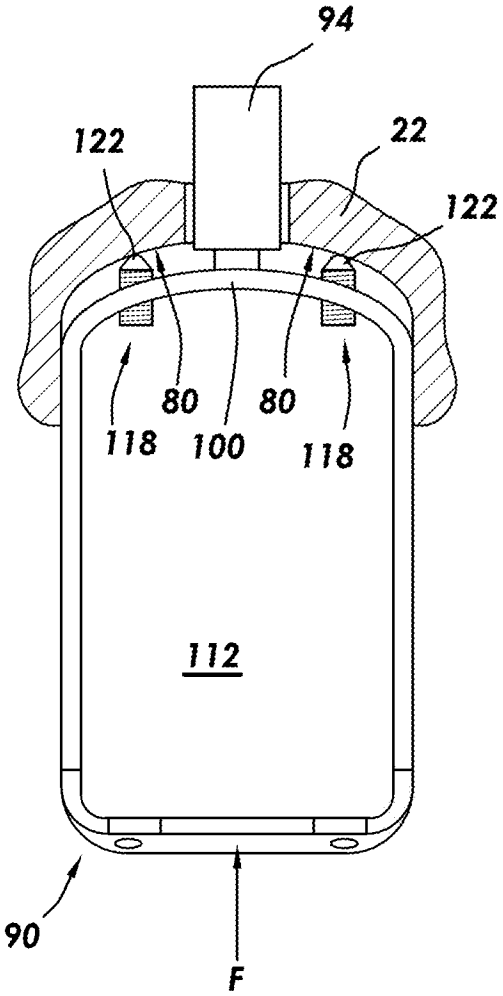
Figure 10A:
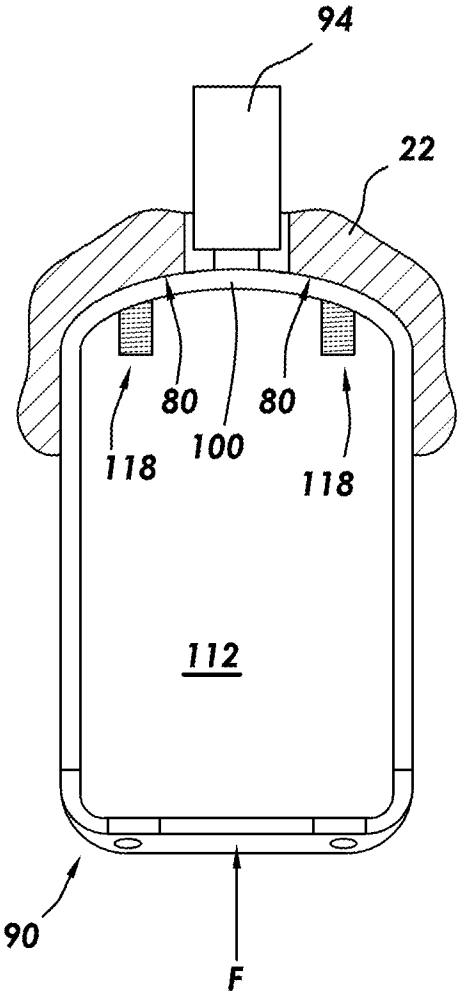

FIGS. 10A-10C show the threaded fastener 118 inserted into each of the receptacles 114, with the embodiment 90 installed in the frame 22 of the firearm 10. The threaded fastener 118 is inserted from within the opening 112 such that the tip 122 faces in a forward direction generally toward the trigger 94 and toward the muzzle end of the firearm when the embodiment 90 is installed. Thus, when the firearm is assembled and the embodiment 90 is installed, the tip 122 can contact the interior wall 80 of the frame 22. The tip 122 of threaded fastener 118 extends out of the receptacles 114 in a forward direction F generally toward the muzzle end 40 of the firearm 10 (see FIG. 1).

How far the tip 122 extends from the front lateral cross member 100 controls the amount of pre-travel adjustment and that distance can be adjusted by rotating the fastener 118. In FIG. 10A, no adjustment has been made and the front lateral cross member 100 is in direct contact with the interior wall 80 of the frame 22. In FIG. 10B, the threaded fastener 118 has been rotated to drive it further into the receptacle 114 and the tip 122 of the fastener 118 is in contact with the interior wall 80. In FIG. 10C, the threaded fastener 118 has been rotated to drive it even further into the receptacle 114 and the tip 122 of the fastener 118 remains in contact with the interior wall 80.

Once the tip 122 is flush with the front end 98 of the bow 96, the more the threaded fastener 118 is driven into the receptacle 114, the more the pre-travel is reduced. In this regard, the tip 122 pushes against the interior wall 80 of the frame 22 to displace the embodiment 90 toward the rear end 42 of the firearm 10. In contrast, rotating the threaded fastener 118 in the opposite direction unscrews it and decreases how far the tip 122 extends from the front end 98 out of the receptacles 114. Thus, unscrewing the threaded fastener 118 allows the embodiment 90 to be pushed further toward the muzzle end 40 of the firearm due to the force of the sear spring 38 on the disconnector 30, thereby increasing the amount of pre-travel.

In sum, to decrease the amount of pre-travel, a user rotates the fastener 118 to drive it further into the threaded receptacles 114, thereby increasing the distance of the tip 122 from the front lateral cross member 100. In contrast, to increase the amount of pre-travel, a user rotates the fastener 118 to back it out of the threaded receptacles 114, thereby decreasing the distance of the tip 122 from the front lateral cross member 100.

Under the present invention, the pre-travel adjustments can be made without disassembling the firearm. To make the adjustments, a user removes the slide of the firearm, a procedure well known in the art. With the slide removed, a user can access the threaded fastener 118 through the top of the firearm.

Figure 11A:
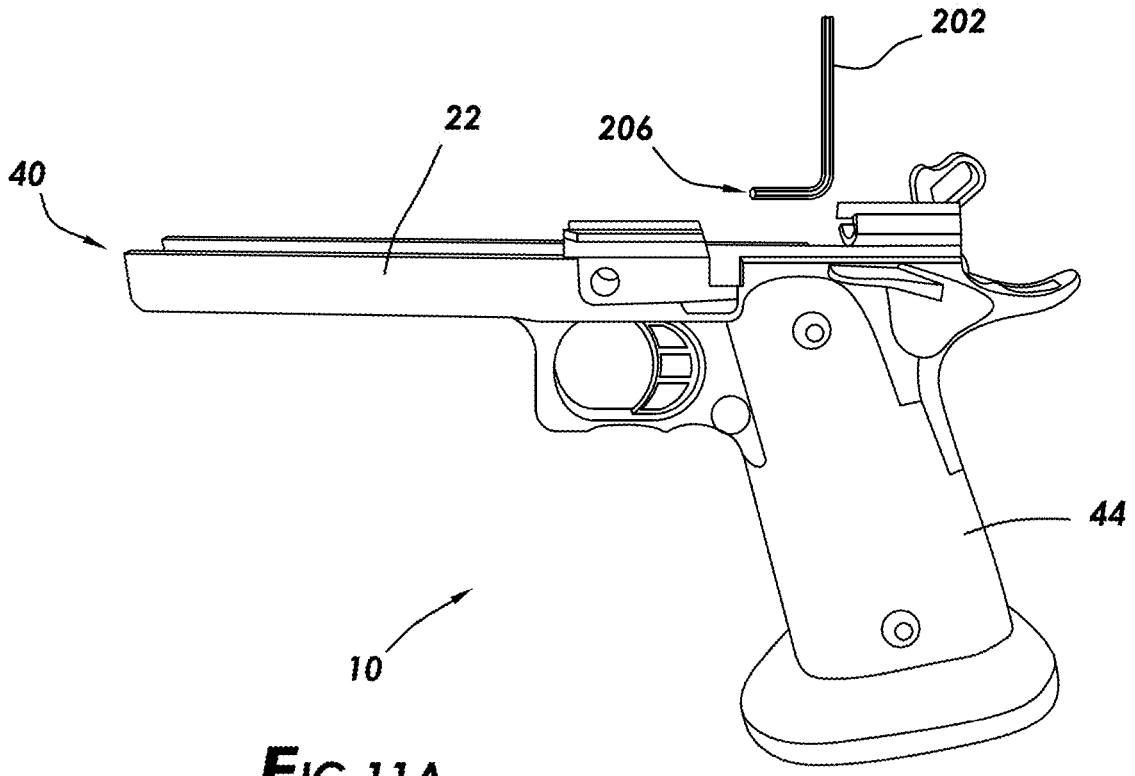
FIG. 11A is a side perspective view of a firearm with the slide removed and with a driving tool positioned above the firearm.
Figure 11B:
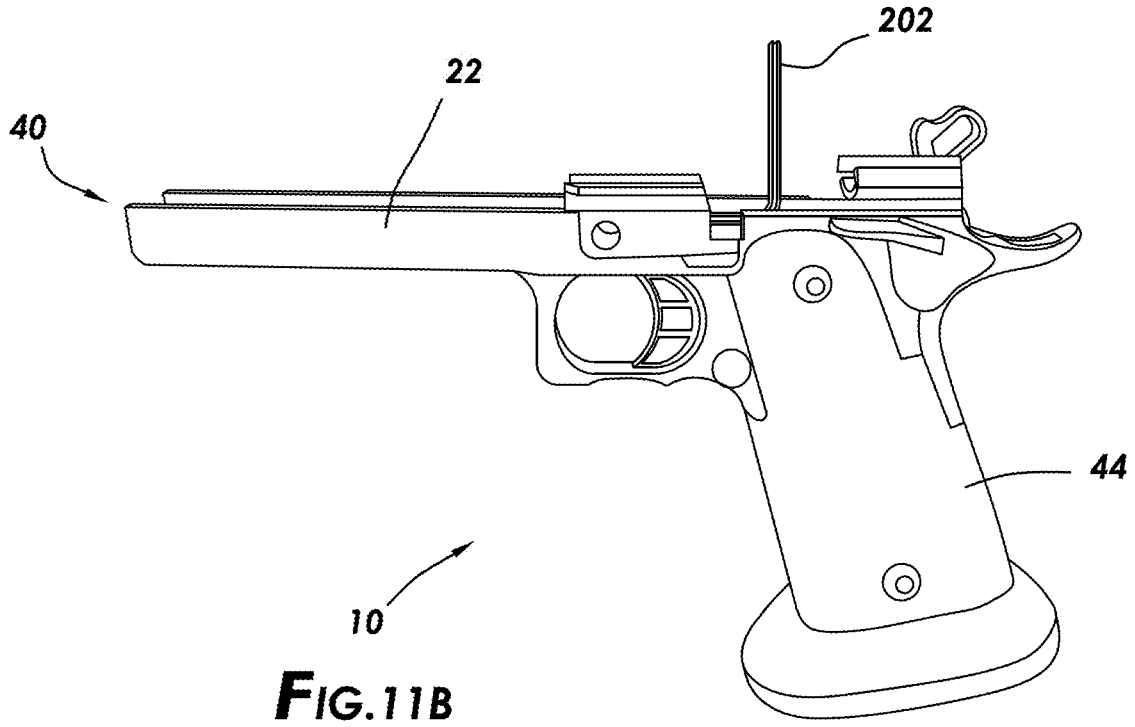
FIG. 11B is the same side perspective view as FIG. 11A, but with the driving tool positioned partially within the firearm.
Figure 12B:
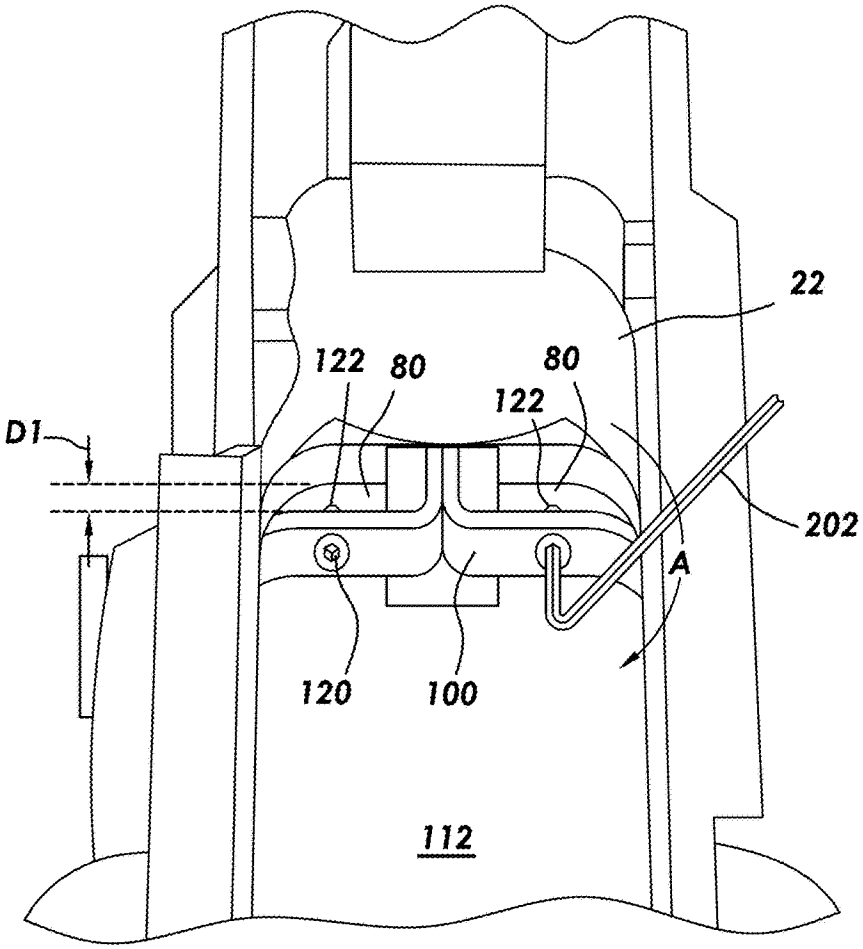
FIG. 12B is the same cutaway top perspective view as FIG. 12A, but with the driving tool inserted into a threaded fastener, an arrow A signifying rotational movement, and distance D1 shown.
Figure 12A:
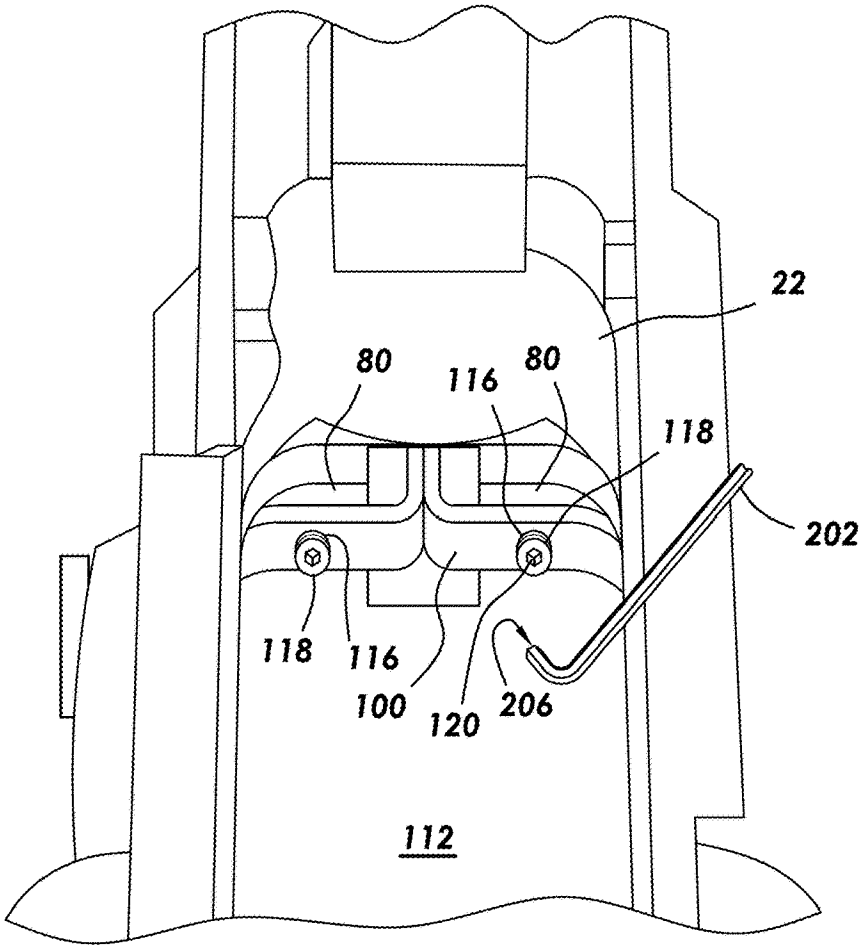
FIG. 12A is a cutaway top perspective view of FIG. 11B.

FIGS. 11-12 illustrate the adjustment process. As shown in FIG. 11A, the firearm 10 has the slide 20 (not shown—see FIG. 1) removed. After removing the slide 20, a user positions a driving tool 202, such as an Allen key, above the firearm 10, generally above the grip 44, with a driving end 206 of the driving tool 202 directed toward the front or muzzle end 40 of the firearm 10. The user then moves the driving end 206 of the driving tool 202 downward into frame 22 of the firearm 10, as shown in FIG. 11B. With the driving end 206 inserted into the frame 22 and directed toward the muzzle end 40 of the firearm 10, the driving end 206 can be positioned within the opening 112 of the trigger bow 96 and inserted into the hexagonal socket 120 of the threaded fastener 118, as shown in FIGS. 12A-12B. The threaded fastener 118 can then be rotated in the appropriate direction for the desired pre-travel adjustment by rotating the driving end 206 from the user's grip on the driving tool 202 outside the frame 22 of the firearm 10.

In FIG. 12A, no pre-travel adjustment has been made and the external threads 116 of the threaded fastener 118 are visible. Accordingly, the front lateral cross member 100 of the embodiment 90 rests against the interior wall 80 of the frame 22. In FIG. 12B, the driving tool 202 has been rotated in a clockwise direction, as shown by arrow A, and the threaded fastener 118 has been driven into the front lateral cross member 100 such that its external threads 116 are no longer visible. As such, the tip 122 of the threaded fastener 118 contacts the interior wall 80 of the frame 22 and the embodiment 90 has been displaced rearward a distance D1, thereby reducing the amount of pre-travel.

Preferably, the driving tool is a moment arm type driving tool that drives a fastener through torque generated by rotating a moment arm. In alternative embodiments, the driving tool may be something other than an Allen key such as, for example, a ninety degree screwdriver, a ratchet, or some other type of driving tool. If a driving tool other than an Allen key is used, the socket 120 on the threaded fastener 118 may be adapted to accommodate a differently shaped driving end of the driving tool. For example, the socket 120 may be star shaped, square shaped, Phillips head, slotted, or any other screw drive socket types.

Additionally, the driving end of the driving tool may be positioned in the opening 112 of the trigger bow 96 through alternative pathways. For example, the driving tool may be inserted through the magazine well at the bottom of the grip 44, rather than through the top of the frame where the slide was located.

After making the desired amount of pre-travel adjustment, the user removes the driving end 206 of the driving tool 202 from the frame 22 and re-installs the slide back on the frame 22.

The present invention is described in terms of a specifically-described embodiment which is presented for purposes of illustration and not of limitation. Those skilled in the art will recognize that alternative embodiments of such device can be used in carrying out the present invention. Other aspects and advantages of the present invention may be obtained from a study of this disclosure and the drawings, along with the appended claims.

I claim:

1. A trigger assembly for a trigger comprising:

a bow having a first end configured for connection to the trigger and a second end opposite the first end, the bow comprising:

a front lateral cross member at the first end;

a rear lateral cross member at the second end;

a first side cross member extending between the front and rear lateral cross members;

a second side cross member extending between the front and rear lateral cross members; and an adjustment means for adjusting a pre-travel of the trigger;

wherein the front lateral cross member comprises an integral piece of material that extends from the first side cross member to the second side cross member.

2. The trigger assembly of claim 1, wherein the bow is configured for use in a 1911-style firearm.

3. The trigger assembly of claim 1 wherein the bow is configured for use in a 2011-style firearm.

4. The trigger assembly of claim 1, wherein the bow is milled from metal stock.

5. The trigger assembly of claim 1 wherein the adjustment means is selected from a group consisting of a bendable adjustment tab and a fastener threaded into the front lateral cross member.

6. A trigger assembly for a trigger comprising:

a bow having a first end configured for connection to the trigger and a second end opposite the first end, the bow comprising:

a front lateral cross member at the first end;

a rear lateral cross member at the second end;

a first side cross member extending between the front and rear lateral cross members; and a second side cross member extending between the front and rear lateral cross members;

wherein a pre-travel of the trigger is adjustable via the bow; and wherein the front lateral cross member comprises an integral piece of material that extends from the first side cross member to the second side cross member.

7. The trigger assembly of claim 6, wherein the bow is configured for use in a 1911-style firearm.

8. The trigger assembly of claim 6, wherein the bow is configured for use in a 2011-style firearm.

9. The trigger assembly of claim 6, wherein the bow is milled from metal stock.

10. The trigger assembly of claim 6 wherein the front lateral cross member defines at least one internally threaded receptacle for adjusting the pretravel of the trigger.

11. The trigger assembly of claim 6 wherein the front lateral cross member includes at least one bendable tab for adjusting the pretravel of the trigger.

12. A trigger assembly for a trigger comprising:

a bow having a first end configured for connection to the trigger and a second end opposite the first end, the bow comprising:

a front lateral cross member at the first end;

a rear lateral cross member at the second end;

a first side cross member extending between the front and rear lateral cross members;

a second side cross member extending between the front and rear lateral cross members; and an adjustment means for adjusting a pre-travel of the trigger;

wherein at least a portion of the front lateral cross member comprises an integral piece of material that extends from the first side cross member to the second side cross member.

13. The trigger assembly of claim 12, wherein the bow is configured for use in a 1911-style firearm.

14. The trigger assembly of claim 12, wherein the bow is configured for use in a 2011-style firearm.

15. The trigger assembly of claim 12, wherein the bow is milled from metal stock.

16. The trigger assembly of claim 12 wherein the adjustment means is selected from a group consisting of a bendable adjustment tab and a fastener threaded into the front lateral cross member.

17. A trigger assembly for a trigger comprising:

a bow having a first end configured for connection to the trigger and a second end opposite the first end, the bow comprising:

a front lateral cross member at the first end;

a rear lateral cross member at the second end;

a first side cross member extending between the front and rear lateral cross members; and a second side cross member extending between the front and rear lateral cross members;

wherein a pre-travel of the trigger is adjustable via the bow; and wherein at least a portion of the front lateral cross member comprises an integral piece of material that extends from the first side cross member to the second side cross member.

18. The trigger assembly of claim 17, wherein the bow is configured for use in a 1911-style firearm.

19. The trigger assembly of claim 17, wherein the bow is configured for use in a 2011-style firearm.

20. The trigger assembly of claim 17, wherein the bow is milled from metal stock.

21. The trigger assembly of claim 17 wherein the front lateral cross member defines at least one internally threaded receptacle for adjusting the pretravel of the trigger.

22. The trigger assembly of claim 17 wherein the front lateral cross member includes at least one bendable tab for adjusting the pretravel of the trigger.

23. A trigger assembly for a trigger comprising:

a bow having a first end configured for connection to the trigger and a second end opposite the first end, the bow comprising:

a front lateral cross member at the first end;

a rear lateral cross member at the second end;

a first side cross member extending between the front and rear lateral cross members;

a second side cross member extending between the front and rear lateral cross members; and an adjustment means for adjusting a pre-travel of the trigger;

wherein at least a portion of the front lateral cross member comprises a single piece of material that extends continuously from the first side cross member to the second side cross member.

24. The trigger assembly of claim 23, wherein the bow is configured for use in a 1911-style firearm.

25. The trigger assembly of claim 23, wherein the bow is configured for use in a 2011-style firearm.

26. The trigger assembly of claim 23, wherein the bow is milled from metal stock.

27. The trigger assembly of claim 23 wherein the adjustment means is selected from a group consisting of a bendable adjustment tab and a fastener threaded into the front lateral cross member.

28. A trigger assembly for a trigger comprising:

a bow having a first end configured for connection to the trigger and a second end opposite the first end, the bow comprising:

a front lateral cross member at the first end;

a rear lateral cross member at the second end;

a first side cross member extending between the front and rear lateral cross members; and a second side cross member extending between the front and rear lateral cross members;

wherein a pre-travel of the trigger is adjustable via the bow; and wherein at least a portion of the front lateral cross member comprises a single piece of material that extends continuously from the first side cross member to the second side cross member.

29. The trigger assembly of claim 28, wherein the bow is configured for use in a 1911-style firearm.

30. The trigger assembly of claim 28, wherein the bow is configured for use in a 2011-style firearm.

31. The trigger assembly of claim 28, wherein the bow is milled from metal stock.

32. The trigger assembly of claim 28 wherein the front lateral cross member defines at least one internally threaded receptacle for adjusting the pretravel of the trigger.

33. The trigger assembly of claim 28 wherein the front lateral cross member includes at least one bendable tab for adjusting the pretravel of the trigger.

* * * * *